US005500980A

United States Patent [19]

Morrow et al.

[11] Patent Number: 5,500,980

[45] Date of Patent: Mar. 26, 1996

[54] CARPET STRIPS AND METHODS OF MAKING CARPET STRIPS AND OTHER EXTRUDED ARTICLES

[75] Inventors: Darrell R. Morrow, Sewell; Leslie D. Morrow, Mullica Hill, both of N.J.

[73] Assignee: Morrow Associated Enterprises, Mickleton, N.J.

[21] Appl. No.: 153,372

[22] Filed: Nov. 16, 1993

[51] Int. Cl.[6] ..... A47G 27/04

[52] U.S. Cl. ..... 16/16

[58] Field of Search ..... 16/16, 7, 4, 8

[56] References Cited

U.S. PATENT DOCUMENTS

| | | | |
|---|---|---|---|
| 118,019 | 8/1871 | Johnston . | |
| 406,451 | 7/1889 | Lange . | |
| 1,100,170 | 6/1914 | Brosius . | |
| 1,412,582 | 4/1922 | Vaile . | |
| 1,610,243 | 12/1926 | Blank . | |
| 1,850,696 | 3/1932 | Scott . | |
| 2,211,574 | 8/1940 | McNicholas | 16/16 |
| 2,429,256 | 10/1947 | Block . | |
| 2,514,335 | 7/1950 | Owens | 16/16 |
| 2,664,589 | 1/1954 | Szpilberg | 16/16 |
| 2,726,419 | 12/1955 | Saks et al. | 16/16 |
| 2,928,115 | 3/1960 | Hill | 16/16 |
| 2,995,769 | 8/1961 | Hill | 16/16 |
| 3,208,095 | 9/1965 | Hill | 16/16 |
| 3,673,633 | 7/1972 | Frebraro | 16/16 |
| 3,693,212 | 9/1972 | Handy | 16/16 |
| 3,924,790 | 12/1975 | Moeller . | |
| 3,950,816 | 4/1976 | Hill | 16/16 |
| 4,970,754 | 11/1990 | Anderson et al. | 16/16 |

FOREIGN PATENT DOCUMENTS

| | | | |
|---|---|---|---|
| 531576 | 10/1956 | Canada | 16/16 |
| 2221838 | 2/1990 | United Kingdom | 16/16 |

*Primary Examiner*—Maurina T. Rachuba
*Assistant Examiner*—Chuck Y. Mah
*Attorney, Agent, or Firm*—Lerner, David, Littenberg, Krumholz & Mentlik

[57] ABSTRACT

A carpet securement includes a polymeric body with a longitudally extending groove in its bottom surface. Tacks or other fasteners protrude upwardly through the body. The tackheads or other drive elements of the fasteners may be lodged within the groove and serve as a bearing element to help support that portion of the body bridging the groove. The body may also be provided with a downwardly projecting riblike support rail inside the groove to help support the body. A groove minimizes the weight of a polymer incorporated in the securement body and further permits flush seating of the fasteners without localized overstressing of the polymer. In an extrusion process useful in making the body or other polymeric elements, sizing dies are provided with devices for maintaining a fluid film between an extrudate passed through the die and the contact surfaces of the die itself.

20 Claims, 3 Drawing Sheets

CARPET STRIPS AND METHODS OF MAKING CARPET STRIPS AND OTHER EXTRUDED ARTICLES

BACKGROUND OF THE INVENTION

The present invention relates to the field of carpet securements commonly referred to as "carpet strips," and further relates to methods of manufacture useful in making carpet strips and other extruded polymeric articles.

Carpeting is commonly installed in buildings using securements known as carpet strips. Each such securement includes an elongated striplike body and many tacks protruding upwardly through the body so that the shanks and points of the tacks extend upwardly from the strip, the heads of the tacks being disposed on the underside of the strip. Nails are prepositioned in the strip by driving them partially through the body from the top surface. In the installation process, the strips are nailed to the floor using these prepositioned nails so that the top surface of the strip faces up, and the shanks and points of the tacks are exposed. When the carpet is forced down onto the top surface of the strip, the points of the tacks engage the carpet backing and hold the carpet in place.

The bodies of carpet strips traditionally have been made of plywood. However, plywood is expensive and it tends to splinter when the tacks and nails are driven. Various proposals have been advanced to replace the wooden bodies of carpet strips with polymeric bodies. Simple direct replacement of wood with a polymer, retaining the same rectangular shape and size used for the wooden strip, ordinarily is impractical both for economic reasons and for technical reasons. The cost of the polymer required to make such a strip typically exceeds the cost of wood even if low cost, recycled polymers are used. If the tacks or other fasteners are driven to full depth, so that the head of each fastener is recessed into the bottom surface of the strip, the polymer can crack. If the polymer does not crack, it may be difficult to drive the fastener all the way in so as to recess the head.

Frebraro, U.S. Pat. No. 3,673,633 discloses various forms of carpet strips, including solid strips and also including strips combining a fluted or grooved polymeric body with a metallic striplike insert. The metallic insert has prongs replacing conventional tacks, so that no tacks are driven through the body. Sutton et al. U.S. Pat. No. 3,828,391 discloses a molded polymeric strip with integrally formed sharp projections for engaging the carpet, as does Nedel U.S. Pat. No. 3,858,269. Anderson et al., U.S. Pat. No. 4,970,754 discloses a carpet strip body in the form of a substantially solid billet of foamed polyurethane. Perhaps because of the costs difficulties associated with producing relatively complex articles as described in these patents, none of these approaches has been widely adopted. Thus, there has been a substantial, unmet need heretofore for improvements in the design of carpet fasteners to facilitate practical application of polymeric bodies in carpet strips.

Additionally, there have been needs for improved methods of polymer processing for forming the polymeric bodies of carpet strips, and for forming other polymeric articles. Elongated polymeric articles commonly are formed by extrusion. In the extrusion process, the polymer, while in a soft condition at a temperature above its melting point and/or glass transition temperature, is forced through an extrusion die. The extruded polymer or "extrudate" is pulled in a downstream direction away from the die and cooled. Where the extrudate includes a gas, the extrudate may be passed through at least one sizing die. For example, the extrudate may be passed through a sizing die chamber having upstream and downstream dies. The downstream die has lips with contact surfaces defining an opening corresponding to the desired size and shape of the article. A subatmospheric pressure is maintained within the sizing die chamber. Under the influence of the subatmospheric pressure within the sizing die assembly chamber, the gas in the extrudate tends to expand, thereby forcing the extrudate into contact with the contact surfaces of the sizing dies. Such a sizing die assembly can assist in maintaining accurate control of the size and shape of the finished product. Unfortunately, use of such a sizing die assembly materially reduces the speed with which the extrudate can be pulled from the extrusion die and thus materially increases the cost of the extrusion process. This renders it considerably less practical for use in production of high volume, relatively low cost items such as carpet strip bodies. There is accordingly an acute need for a solution to this problem as well.

SUMMARY OF THE INVENTION

The present invention, in its various aspects, addresses these needs.

One aspect of the present invention provides a carpet securement including a polymeric body in the form of an elongated strip. The strip has top and bottom surfaces and a longitudinally extending groove in the bottom surface. The bottom surface of the body may have a pair of lands substantially coplanar with one another and extending on opposite sides of the groove. The lands are adapted to bear on a floor when the securement is disposed on the floor. Moreover, the securement includes bearing means for engaging the floor within the groove so as to support the body between the lands when the securement is disposed on the floor. The securement desirably also includes means for engaging a carpet overlying the top surface, desirably in the form of a plurality of fasteners, such as metallic fasteners. The fasteners have shanks protruding upwardly through the body. The distal or point ends of the shanks of the fasteners are disposed above the top surface of the body. The fasteners desirably include drive elements such as heads, the drive elements being disposed in the groove. For example, where the fasteners are tacks, the heads of the tacks lie in the groove.

This aspect of the invention incorporates the realization that provision of a groove in the bottom surface will materially reduce the weight of polymer incorporated in the strip and will also provide a location where the drive elements of the fasteners can be accommodated without forcing the same into the polymer. This aspect of the present invention incorporates the additional realization that, when a strip having such a groove is nailed to the floor, as by nails passing through the body of the strip within the lateral extent of the groove, that portion of the strip above the groove is stressed in bending. Thus, the downward force applied by the nails used to fasten the strip to the floor is applied above the groove, and tends to bow that portion of the strip bridging the groove downwardly towards the floor. Such stress can cause stress cracking of the strip body. The bearing means incorporated in the preferred fasteners according to the present invention provide a countervailing upward force within the groove, in the immediate vicinity of the nails and thereby substantially eliminates any such stress cracking.

The bearing means may include the drive elements of the fasteners. Thus, the drive elements of the fasteners may be disposed so that they can engage the floor when the securement is disposed on the floor. Accordingly, the drive elements will serve to support the body in the region between the lands. Preferably, the fastener drive elements are disposed in one or more rows and the fastener includes prepositioned nails engaged with the body so that when the nails are fully driven, the heads of the nails will be laterally aligned with or adjacent the fastener drive elements. Alternatively or additionally, the body may include a support rail projecting downwardly within the groove. The support rail has a bottom face which bears upon the floor when the fastener is positioned on the floor. The prepositioned nails are disposed so that the heads of the nails will be laterally aligned with or adjacent the support rail when the nails are fully driven. Thus, the upward forces provided by the support rail, by the fastener drive elements or both support the portion of the body overlying the groove and substantially prevent distortion and stress cracking of the body. Moreover, because the drive elements can be partially or completely lodged within the groove, there is no need to force the drive elements into the body of the strip to make them coplanar with the lands. This further reduces the possibility of cracking in the strip.

Most desirably, the strip is formed from a foamed polymer. The foamed polymer constitutes a matrix, and desirably incorporates fibrous reinforcements.

Further aspects of the present invention provide improved methods of forming polymeric articles. Methods according to this aspect of the invention include the steps of extruding a polymer to form a soft, deformable extrudate with a blowing agent in the extrudate and advancing said extrudate in a downstream direction through at least one sizing die so that the blowing agent tends to expand the extrudate into engagement with the sizing die. For example, the extrudate may pass through a first or upstream sizing die into a sizing die assembly chamber and out of this chamber in the downstream direction through a downstream sizing die. There may be one or more intermediate sizing dies in the chamber. The interior of the die assembly chamber typically is maintained at a pressure below the ambient pressure outside of the die chamber. Thus, the blowing agent inside the extrudate will tend to expand and to force the extrudate outwardly within the chamber, so that the extrudate engages the contact surfaces of at least one of the sizing dies. The extrudate thereby conforms to the size and shape of that sizing die. Methods according to this aspect of the invention most preferably include the further step of introducing a fluid, preferably a gas such as air, so that the fluid forms a film between the extrudate and the contact surfaces of the sizing die or dies. The film materially reduces friction between the extrudate and the dies. This in turn permits rapid movement of the extrudate through the dies, thereby materially enhancing the speed of the process.

The blowing agent may be dispersed within the polymer of the extrudate, so that the blowing agent tends to foam the extrudate. Alternatively, the blowing agent may be a volatile liquid or gas disposed in a discrete bore or bores within the extrudate, so that the blowing agent tends to inflate the bore and thus expand the surrounding portions of the extrudate.

In formation of carpet securement bodies or other elongated, striplike elements, the extrudate may be in the form of a generally platelike or sheetlike element, and the process may further include the step of slitting the extrudate in a lengthwise direction after passage through the sizing die assembly to thereby form a multiplicity of striplike elements.

These and other objects, features and advantages of the present invention will be more readily apparent from the detailed description of the preferred embodiments set forth below, taken in conjunction with the accompanying drawings.

DETAILED DESCRIPTION OF THE PREFERRED EMBODIMENTS

Figure 1:
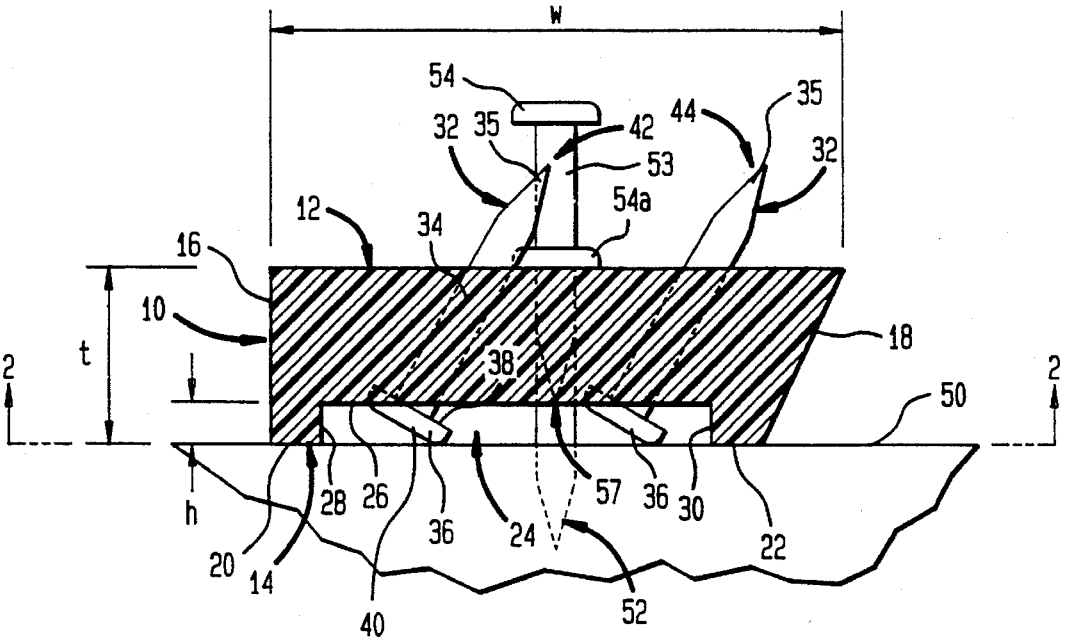
FIG. 1 is a sectional elevational view depicting a carpet securement according to one embodiment of the invention.

A carpet securement in accordance with one embodiment of the invention includes an elongated striplike polymeric body 10 having a top surface 12, a bottom surface 14, a first generally vertical edge 16 extending between the top and bottom 12 and 14 surfaces and a second, inclined edge 18 also extending between the top and bottom surfaces. The bottom surface 14 has a first, generally horizontal land 20 adjacent to the first edge 16 of the strip, and also has a second, generally horizontal land 22 adjacent to the inclined edge 18. Lands 20 and 22 are substantially coplanar with one another and cooperatively define the bottom plane of the body. The bottom surface 14 also has a groove 24 between lands 20 and 22. Groove 24 has a top surface 26 recessed above lands 20 and 22 by a preselected groove height h. The top surface 26 of the groove extends generally horizontally, and is bounded by a first vertical groove wall 28 extending from surface 26 to land 20 and a second, opposite groove wall 30, extending downwardly from the top surface 26 of the groove to land 22.

Body 10 is formed from a foamed polymer. The foamed polymer may consist predominantly of a polyolefin component. That is, the polyolefin component may constitute more than 50% of the polymer by weight. In some cases, the foamed polymer may consist entirely or essentially of the polyolefin component. The polyolefin component itself may consist essentially or entirely of polyethylene, of polypropylene or of mixtures of these, or else may include appreciable amounts of other olefin polymers. The foamed polymer may include non-olefinic polymers such as polyethylene terephthalate, nylon and combinations thereof, alone or in admixture with the polyolefin component. Some or all of the foamed polymer can consist recycled plastic, preferably refined or unrefined postconsumer plastics waste.

Reinforcing fibers such as glass, metal, wood or polymeric fibers may be disposed in the foamed polymer. The fibers may be individual fibers dispersed throughout the polymer, or else may be provided as ordered structures such as knit or woven layers, rovings and the like. Non-fibrous reinforcements and other additives may also be disposed in the polymer. The additives may include bonding agents to enhance bonding between the fibrous and non-fibrous reinforcements and the polymer.

When used with reference to the features of the carpet securement, or of components thereof such as body 10, the terms "top", "bottom", "up" and "down" refer to the positions and directions which the carpet securement or component will have during use. Thus, the "bottom" surface is the surface intended to face towards the floor in use. The term "lengthwise" refers to the lengthwise direction of the striplike body, i.e., to the direction from the top to the bottom of the drawing in FIG. 2, and in and out of the plane of the drawing in FIG. 1. The terms "widthwise" and "laterally" refers to the direction transverse to the lengthwise direction and also transverse to the upward and downward directions. Thus, the lateral or widthwise directions are directions from left to right as seen in FIG. 1.

Body 10 is a profile of substantially constant dimensions over its entire length. The thickness or vertical dimension t may be between about 0.2 and about 0.3 inches, and typically about 0.27–0.28 inches, whereas the maximum width or lateral dimension w at top surface 12 may be about 0.75 to about 1.25 inches, and preferably about 1.0 inches. The height h or vertical extent of groove 24, from land surfaces 20 and 22 to groove top surface 26 may be between about 0.04 to about 0.08 inches, and preferably about 0.06 inches. The width or lateral dimension of the groove between wall 28 and wall 30 may be about 0.5 to about 0.75 inches and preferably about 0.680 inches. Body 10 may have any convenient length, but most commonly is made in lengths of about 4 feet for convenient handling during installation. However, the body may also be made in semi-continuous coil form, so that tens or hundreds of feet of the body are incorporated in a single piece.

Figure 2:
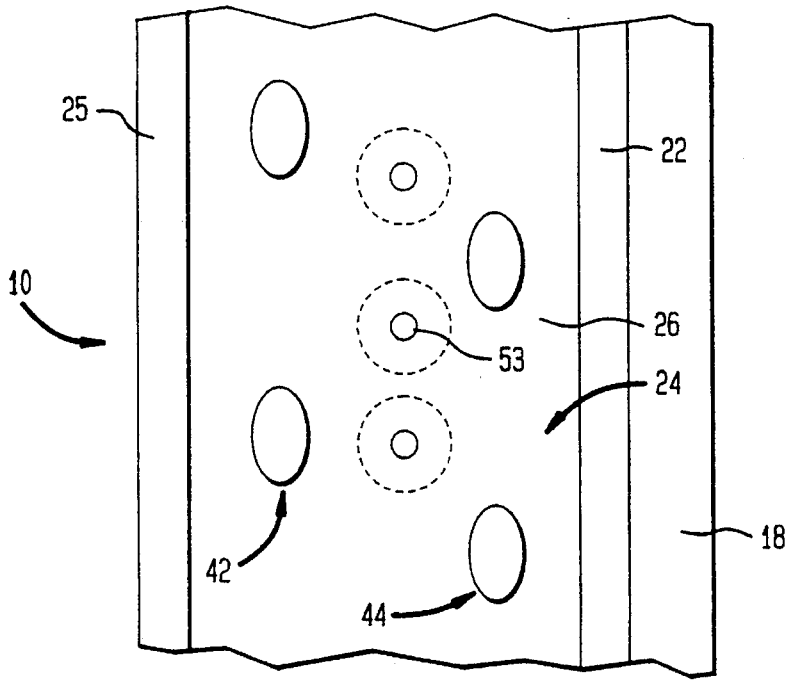
FIG. 2 is a bottom view of the carpet securement illustrated in FIG. 1, taken along line 2—2 in FIG. 1.

The securement also includes a plurality of fastening elements such as tacks 32. Each tack has an elongated shank 34 with a point 35 at a distal end and a head 36 at a proximal end. The head has a shank surface 38 facing towards the shank of the tack and a drive surface 40 opposite from the shank surface. The tacks are driven through the body upwardly from the groove 24, so that the shank 34 of each tack penetrates that portion of the body overlying the groove and protrudes above the top surface 12 of the body. Thus, the points 35 of the tacks are exposed above the top surface. The shanks 34 of the tacks are disposed at an angle of about 50 to about 70 degrees, preferably about 60 degrees to the horizontal. The heads 36 of all of the tacks are lodged within groove 24, with the shank surface 38 of each tack head bearing on the top surface 26 of the groove. The head 36 of each tack extends downwardly from groove top surface 26, so that the lowest point of each such head lies at or close to the plane of the body surface defined by lands 20 and 22. Desirably, the lowest point on the head of each tack is substantially flush with or slightly recessed above, the bottom plane of the body. Thus, each head is positioned between about 0.000 inches and about 0.015 inches above the bottom plane defined by lands 20 and 22. Tacks 32 are disposed generally in two parallel rows 42 and 44, these rows being offset in the lateral or widthwise direction from one another. The heads of the tacks in rows 42 and 44 are generally in staggered arrangement, as illustrated in FIG. 2, so that the heads of the tacks in row 42 are displaced in the lengthwise direction of the body from the heads of the tacks in row 44. Typically, about 50 to about 80 tacks, and more preferably about 56 to about 72 tacks, are provided in each 4-foot long body section.

Because the heads are received in groove 24, little or no deformation of the material of the body is required to seat the heads flush with the plane of lands 20 and 22. Also, because the tacks can be seated within the groove, each tack may be slightly shorter than would be required in the absence of the groove, thereby providing some savings in the material used for the tacks. Although such savings is small for each tack, the cumulative savings over many millions of tacks are significant. Preferably, the shank of each tack is between about 0.375 and about 0.5 inches long, and protrudes upwardly above the top surface by about 0.1 inches to about 0.2 inches as measured in the vertical direction rather than along the length of the shank.

The securement further includes nails 52. The nails are driven into body 10 in the central region, overlying the groove 24 so that the shank or elongated portion of each nail penetrates through the body and the point 57 of the nail initially is disposed at the top of groove 24, as illustrated in solid lines in FIG. 1. The shanks 53 of the nails are disposed in the lateral region between the rows of tack heads 42 and 44. In particular, the intersection of each shank and the top surface 12 of the body is disposed laterally between the lowest points of the tack heads. Typically, about 6 to 8 nails are provided in each 4-foot long body section.

In use, the securement, with the body, nails and tacks in position as shown, is disposed on a floor with the bottom surface 14, and hence lands 20 and 22, bearing on the floor. Top surface 12 faces upwardly and the inclined side surface 18 faces away from the area to be covered by the carpet so that the shanks 34 of the tacks are also inclined away from the area to be covered by the carpet. Nails 52 are driven downwardly into the floor so that the head 54 of each nail bears on top surface 12 in a region positioned laterally between the rows of tack heads 36 and, more specifically, laterally within the region encompassed between the lowest points of the tack heads in the two rows. As the shanks 53 of the nails engage the floor, the nail heads 54 apply downward forces to the top surface of the body, thereby holding the securement in place. This force is transmitted through the body 10 to the tack heads 36 through the shank surfaces 38 of the tack heads. The tack heads bear on the floor 50 and transmit the downward load to the floor. The tack heads exert a countervailing, upward force on the body, and thus support that portion of the body overlying groove 24. This substantially eliminates any tendency of the body to deform and stress crack due to the downward forces applied by nails. With the securement in place, the carpet is engaged with the points and shanks of the tacks in the conventional manner.

Figure 3:
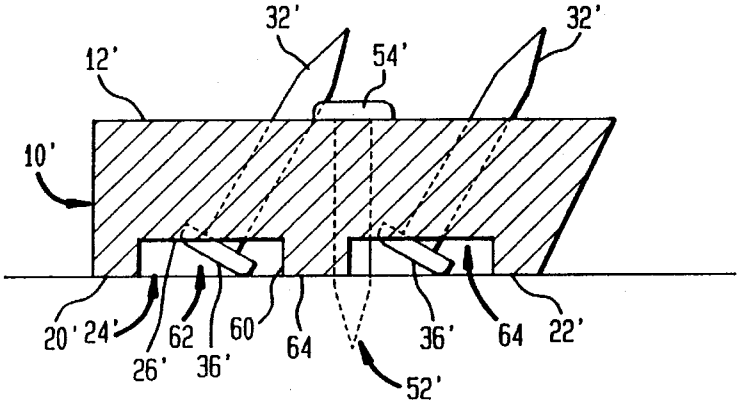
FIG. 3 is a sectional view similar to FIG. 1 but depicting a securement in accordance with a further embodiment of the invention.

A securement in accordance with a further embodiment of the invention is illustrated in FIG. 3. The fastener of FIG. 3 is identical to the fastener of FIGS. 1 and 2. However, the body 10' of the fastener in FIG. 3 has a support rail 60 protruding downwardly from the upper surface 26' of the groove 24', thus subdividing groove 24' into two smaller grooves 62 and 64. Support rail 60 has a bottom face 64 at the bottom surface of body 10', i.e., substantially coplanar with lands 20' and 22'. Support rail 60 is positioned laterally approximately at the midpoint of groove 24'. Tacks 32' are positioned in body 10' in two laterally spaced rows, in the same manner as discussed above with respect to FIGS. 1 and 2. The heads 36' of the tacks in the two rows lie on opposite sides of support rail 60. Also, nails 52' are positioned so that the shanks 53' of the nails 52' pass through or close to the support rail.

The securement of FIG. 3 operates in substantially the same way as the fastener of FIGS. 1 and 2. After the securement is positioned and nailed in place by driving home nails 52', a carpet is secured in place by engaging the carpet with the upwardly protruding points and shanks of tacks 32. The nail heads 54 are laterally aligned with the support rail 60. Support rail 60 and particularly its bottom face 64, provides additional support to the body in the area overlying the groove, and provides further reinforcement against the downward loads applied by nails 52'. This additional support is provided with very little additional material in the body. The tack heads also provide support to the body as discussed above.

In a variant of the securement, the nails can be supplied separately and inserted at the time of installation. The top surface of the body may be provided with indicia, score lines, small grooves, depressions or the like to indicate the proper nail positions. Also, fasteners other than tacks may be employed. Nails, brads, and wire-formed fasteners can be used. It is not essential that the fasteners have individual heads. Thus, some fasteners incorporate a plurality of shanks protruding from a single drive element, so that the single drive element serves the same function as the heads of the individual tacks. For example, staples and fasteners formed from wire may incorporate two legs and a crossbar connecting the legs and serving as a drive element. Other fasteners formed from metal strips may include numerous projections extending from a common metal strip so that the metal strip serves as the drive element. In any case, the shanks can be driven into the body of the securement leaving the single drive element seated in the groove of the body. Thus, the single drive element may serve to support the body in substantially the same way as the individual tack heads.

Figure 4:
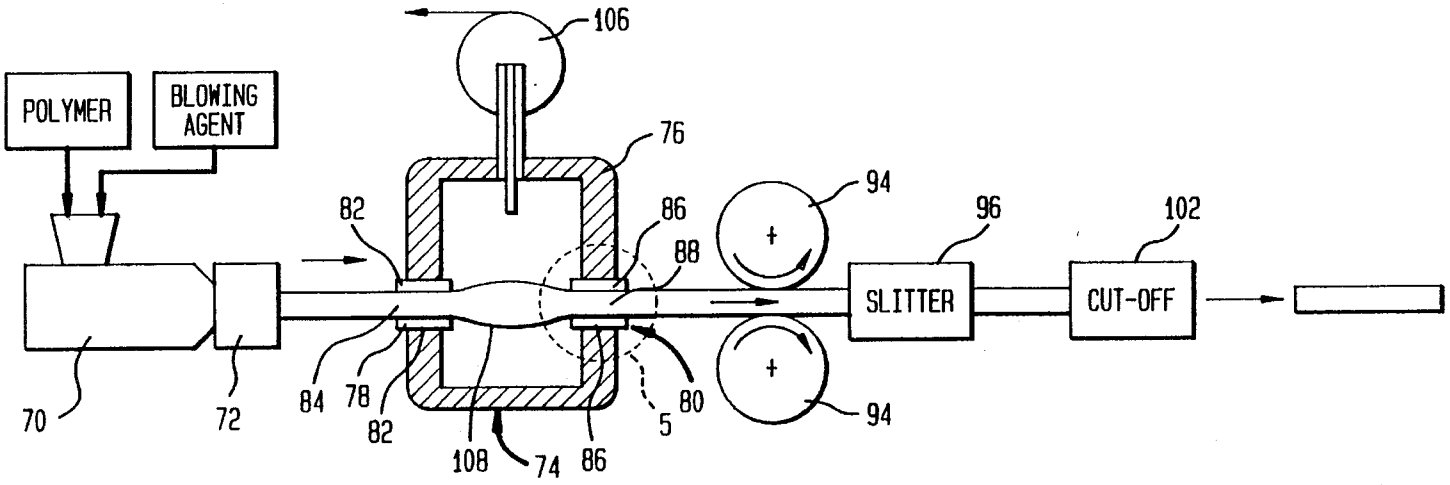
FIG. 4 is a schematic, partially sectional view of a manufacturing process and apparatus in accordance with one embodiment of the invention.
Figure 5:
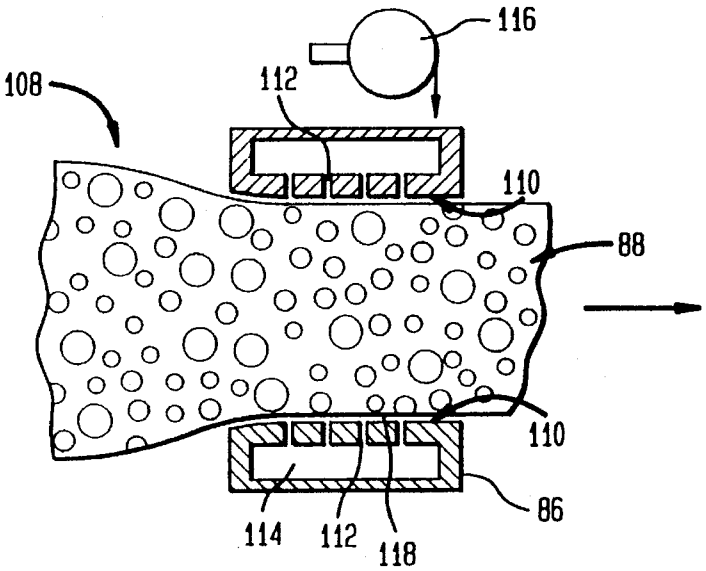
FIG. 5 is a fragmentary sectional view depicting a portion of the process and apparatus illustrated in FIG. 4.

The bodies of the carpet securements discussed above can be made using the process illustrated in FIGS. 4 and 5. A conventional extruder 70 of the type commonly used to extrude polymeric foams is supplied with the polymer to be incorporated in the body along with a conventional blowing agent. Numerous different blowing agents are known. These include both volatile liquids such as hydrocarbons, chlorinated hydrocarbons and water, as well as materials commonly handled in the gaseous state such as nitrogen and air. The polymer may carry the reinforcements and fillers desired in the final product, such as fibers, particulate reinforcements, coupling agents and any of the other additives commonly employed in plastics processing and compounding. Also, the blowing agent may be supplied with the polymer. Thus, commercially available polymer pellets which incorporate blowing agents trapped or dissolved therein may be used. Extruder 70 is operated in the conventional manner to provide a hot, softened, semi-fluid polymer extrudate, with the additives, reinforcements and blowing agents dispersed therein.

The extrudate is discharged in a downstream direction, towards the right as seen in FIG. 4, through a conventional extrusion die 72. Extrusion die 72 has a cross-sectional shape similar to the shape of the desired extrudate. In the process of FIG. 4, the extrudate is formed as a relatively wide sheet or plate, as further discussed below, so that die 72 has a cross-sectional shape generally in the form of an elongated slit extending perpendicular to the downstream direction, i.e., extending into and out of the plane of the drawing in FIG. 4. The extrudate, while still warm and deformable, and preferably while still at above the processing temperature of the polymer constituting the extrudate, passes into a sizing die assembly 72.

Figure 6:
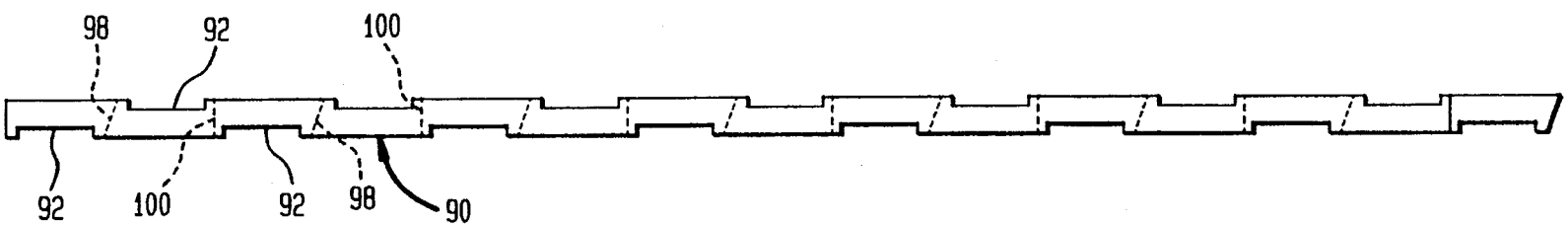
FIG. 6 is an end view depicting a portion of a semi-finished extruded profile used in the process of FIGS. 4–5.

Die assembly 72 includes a box 76 defining a chamber, an upstream die 78 on the upstream side of box 76 and a downstream die 80 on the downstream side of the box. Upstream die 78 has die lips 80 defining an opening 84, also generally in the form of an elongated slit similar to the shape of the extrudate. Downstream die 80 has similar lips 86 defining an opening 88 in a size and shape very close to that of the desired extrudate. As best illustrated in FIG. 6, the desired extrudate 90 is generally in the form of a sheet equal in width to fifteen of the desired carpet strip bodies. Indentations 92, corresponding to the grooves in the final carpet strip bodies are formed in staggered arrangement in the top and bottom surfaces of the extrudate. Thus, the lips 86 of downstream die 80 have a configuration corresponding to these staggered indentations. After the extrudate passes downstream from the die assembly, it is cooled, as by contact with air, water or other fluids (not shown) in conventional equipment, and engaged by conventional pulloff belts or rollers 94, which feed the extrudate to a slitter 96. Slitter 96 cuts the extrudate along alternating inclined planes 98 and vertical planes 100 so as to subdivide the extrudate into individual strips corresponding to the fastener bodies discussed above. The slitter may include conventional blades such as rotary or belt saws. Preferably, however, the slitter includes a fluid-jet or water-jet cutter. These separated strips then pass to a cutoff unit 102 which cuts the strips to length. Before or after cutoff unit 102, the strips or bodies can be provided with tacks, and with nails as discussed above, using conventional inserting equipment (not shown).

Die chamber 76 is connected to a vacuum pump 106 which maintains the interior of the chamber under a subatmospheric pressure, i.e., less than the ambient atmospheric pressure surrounding the extrudate outside of the die chamber. Thus, as the extrudate enters the die chamber, the blowing agent within the extrudate tends to inflate and expand the extrudate, forming a bulge or bubble 108 within chamber 76. The extrudate therefore tends to engage the surfaces of die lips 82 and 86 bounding the openings 84 and 88. For example, the extrudate tends to engage the contact surface 110 (FIG. 5) of die lips 86 bounding the opening 88 of the downstream die. Die lips 86, however, have numerous holes 112 opening through their contact surfaces 110, these passages being connected via a plenum 114 to a conventional air compressor 116. The air is supplied under pressure to plenum 114 and discharged through holes 112 so that the air forms a film 118 between the contact surface 110 of the die lip and the extrudate. In FIG. 5, the thickness of film 118 is greatly exaggerated for clarity of illustration. Most preferably, the film is only a few thousandths of an inch thick, so that the extrudate closely conforms to the contact surfaces 110 of the die lips despite the film, and so that the air constituting the film does not overwhelm the capacity of vacuum pump 106. The lips 82 of upstream die 78 are similarly equipped with holes (not shown) in their contact surfaces, to provide a similar film. The films substantially eliminate the friction between the extrudate and the die lips which would normally be caused by engagement of the extrudate with the die. This, in turn, permits operation of puller 94 and extruder 70 at a higher speed, without damage to the extrudate as it passes through the die. The lubricating effect of the fluid film also substantially reduces abrasion of the die contact surfaces.

Although only two sizing dies are illustrated in FIG. 4, the sizing die assembly may include numerous sizing dies including one or more intermediate sizing dies within the die assembly chamber. Normally, the dies in the assembly are shaped progressively, so that each die is slightly closer to the desired final shape then the preceding (next upstream) die. All or less then all of the dies may be provided with the fluid film— forming features discussed above.

Gases other than air can be supplied through the plenum to form the film in the process as described above. Also, liquids which are chemically compatible with the extrudate can be employed instead of gases. The holes in the contact surfaces can be provided in porous elements incorporated in the contact surfaces. The fluid forming the film also can be introduced between the extrudate and the contact surfaces of the dies in ways other than holes in the contact surfaces as, for example, by introducing the fluid at the upstream edge of the die. The sizing dies may be provided with contact surface features such as small grooves extending in the upstream-to-downstream direction, to facilitate development of an air film between the polymer and contact surfaces. The draw-down and speed of advance of the polymer through the die can also influence development of the fluid film where the fluid is introduced at the upstream side of the die. Relatively fast throughput speed and high drawdown ratio tend to enhance film formation.

The fluid film arrangement discussed above can be applied to extrusion of other shapes. In the process discussed above, the blowing agent is dispersed throughout the polymer. However, in production of tubular products, the extrudate may incorporate one or more bores and the blowing agent may be provided as a volatile liquid or gas under pressure inside of the bores, so as to provide a controlled internal pressure. Such internal pressure tends to inflate the extrudate in a similar manner as the dispersed blowing agent, and hence the fluid film technique can be employed with this system as well. If the extrude has plural bores, the pressure may be controlled separately in each bore.

As numerous variations and combinations of the features discussed above can be utilized without departing from the present invention, the foregoing description of the preferred embodiments should be taken by way of illustration rather than by way of limitation of the invention as defined by the claims.

What is claimed is:

1. A carpet securement comprising a polymeric body in the form of an elongated strip having top and bottom surfaces and lateral edges bounding said surfaces, said body further including a longitudinally-extending groove in said bottom surface, said bottom surface of said body having a pair of substantially coplanar lands extending longitudinally on opposite sides of said groove and adapted to bear on a floor when the securement is disposed on a floor, the securement further including bearing means for engaging a floor within said groove to thereby support said body when the carpet securement is disposed on a floor, the securement further comprising carpet engaging means for engaging a carpet overlying said top surface, said carpet-engaging means including a plurality of fasteners having shanks protruding above said top surface, said fasteners having drive elements positioned in said groove and being disposed so that they can engage a floor when the fastener is disposed on a floor, whereby said drive elements of said fasteners will serve to support said body between said lands, said bearing means including said drive elements of said fasteners.

2. A carpet securement as claimed in claim 1 wherein said drive elements of said fasteners are disposed in one or more rows, the securement further comprising a plurality of nails having heads and having elongated shanks protruding into said body, said shanks passing through said top surface at locations disposed laterally between said rows of drive elements whereby when said nails are driven home, said heads will be on said top surface at said locations disposed laterally between said drive elements.

3. A carpet securement as claimed in claim 2 wherein the lowest portion of each said drive element is positioned at a vertical distance of less than about 0.015 inches from said lands.

4. A carpet securement as claimed in claim 2 wherein said groove has a substantially horizontal top surface and wherein said drive elements bear on said top surface of said groove.

5. A carpet securement as claimed in claim 2 wherein said strip is between about 0.75 and about 1.25 inches wide and wherein said groove is at least about 0.5 inches wide.

6. A carpet securement as claimed in claim 5 wherein said groove is between about 0.04 and about 0.06 inches high.

7. A carpet securement as claimed in claim 1 wherein said fasteners are tacks, said tacks have heads disposed in said groove, each said head having an upwardly-facing shank surface facing the shank of the tack and bearing on said body in said groove.

8. A carpet securement as claimed in claim 1 wherein said groove has a top surface, said body having an elongated support rail protruding downwardly from said top surface within said groove, said support rail having a bottom surface for engaging the floor when the securement is disposed on the floor, said bearing means also including said support rail.

9. A carpet securement as claimed in claim 8 wherein said bottom surface of said support rail is substantially coplanar with said lands.

10. A carpet securement comprising a polymeric body in the form of an elongated strip having top and bottom surfaces and lateral edges bounding said surfaces, said body further including a longitudinally-extending groove in said bottom surface, said bottom surface of said body having a pair of substantially coplanar lands extending longitudinally on opposite sides of said groove and adapted to bear on a floor when the securement is disposed on the floor, the securement further including bearing means for engaging a floor within said groove to thereby support said body when the carpet securement is disposed on the floor, said groove having a top surface said body having an elongated support rail protruding downwardly from said top surface within said groove, said support rail having a bottom surface substantially coplanar with said lands for engaging a floor when the securement is disposed on a floor, said bearing means also including said support rail, the securement further including fasteners having shanks protruding above said top surface for engaging a carpet, said fasteners also having drive elements disposed in said groove.

11. A carpet securement as claimed in claim 10 wherein said drive elements of said fasteners are disposed on opposite sides of said support rail.

12. A carpet securement as claimed in claim 11, further comprising a plurality of nails each having a head and a shank, said shanks of said nails protruding into said body and penetrating said top surface above said groove end laterally adjacent said support rail, whereby when said nails are driven home said heads of said nails will bear on said top surface of said body above said groove and laterally adjacent said support rail.

13. An assembly as claimed in claim 12 wherein said shanks of said nails protrude into said support rail.

14. A carpet securement as claimed in claim 4 or claim 10 wherein said polymeric body incorporates a foamed polymer.

15. A carpet securement as claimed in claim 14 wherein said body includes reinforcing fibers dispersed in said foamed polymer.

16. A carpet securement as claimed in claim 14 wherein said foamed polymer includes at least about 50% of a polyolefin component.

17. A carpet securement as claimed in claim 16 wherein said polyolefin component consists essentially of one or more polymers selected from the group consisting of polyethylene, polypropylene and mixtures thereof.

18. A carpet securement as claimed in claim 16 wherein said foamed polymer consists essentially of said polyolefin component.

19. A carpet securement as claimed in claim 14 wherein said foamed polymer includes one or more non-olefin components selected from the group consisting of polyethylene terephthalate, nylon and combinations thereof.

20. A carpet securement as claimed in claim 14 wherein said foamed polymer includes postconsumer recycled plastics.

* * * * *